US011286730B2

(12) United States Patent
Georgiou

(10) Patent No.: US 11,286,730 B2
(45) Date of Patent: Mar. 29, 2022

(54) CABLE FEEDER AND DRILL RIG

(71) Applicant: Joy Global Underground Mining LLC, Warrendale, PA (US)

(72) Inventor: Michael Georgiou, Moss Vale (AU)

(73) Assignee: Joy Global Underground Mining LLC, Warrendale, PA (US)

( * ) Notice: Subject to any disclaimer, the term of this patent is extended or adjusted under 35 U.S.C. 154(b) by 73 days.

(21) Appl. No.: 16/747,282

(22) Filed: Jan. 20, 2020

(65) Prior Publication Data

US 2020/0232288 A1 Jul. 23, 2020

Related U.S. Application Data

(60) Provisional application No. 62/794,915, filed on Jan. 21, 2019.

(51) Int. Cl.

| | |
|---|---|
| ***E21B 19/084*** | (2006.01) |
| ***E21B 19/02*** | (2006.01) |
| *E21B 17/18* | (2006.01) |

(52) U.S. Cl.

CPC ..... *E21B 19/084* (2013.01); *E21B 19/02* (2013.01); *E21B 17/18* (2013.01)

(58) Field of Classification Search

CPC . E21B 7/02; E21B 7/025; E21B 7/021; E21B 19/087; E21B 19/084; E21D 20/003

See application file for complete search history.

(56) References Cited

U.S. PATENT DOCUMENTS

| | | | | |
|---|---|---|---|---|
| 4,262,756 | A * | 4/1981 | Blanz | E21B 19/08 173/149 |
| 4,429,753 | A * | 2/1984 | Cushman | E21B 19/08 173/149 |
| 4,472,002 | A * | 9/1984 | Beney | E21B 19/084 384/24 |
| 4,619,310 | A * | 10/1986 | Andoh | B22D 11/1282 164/442 |
| 4,898,251 | A * | 2/1990 | Clark | E21B 19/084 173/145 |
| 5,427,295 | A | 6/1995 | David | |
| 6,105,684 | A | 8/2000 | Pointer et al. | |
| 6,367,778 | B1 | 4/2002 | Mobley et al. | |
| 9,272,874 | B1 | 3/2016 | Davis, Jr. | |

(Continued)

FOREIGN PATENT DOCUMENTS

| | | |
|---|---|---|
| AU | 2010200388 B2 | 4/2016 |
| CN | 106121714 A | 11/2016 |
| CN | 207765890 U | 8/2018 |

OTHER PUBLICATIONS

International Search Report and Written Opinion for Application No. PCT/US2020/014268 dated Apr. 9, 2020 (12 pages).

*Primary Examiner* — Kipp C Wallace

(74) *Attorney, Agent, or Firm* — Michael Best & Friedrich LLP

(57) ABSTRACT

A cable feed tool includes a first support, a second support coupled to the first support, a first roller supported on the first support for rotation and configured to drive a cable, and a second roller supported on the second support for rotation and configured to drive the cable. The first roller is also supported for pivoting movement relative to the second support about a pivot axis. The second roller is also supported for translational movement relative to the first support.

18 Claims, 8 Drawing Sheets

(56) References Cited

U.S. PATENT DOCUMENTS

| | | | | |
|---|---|---|---|---|
| 2005/0062030 | A1* | 3/2005 | Wentworth | E21B 7/20 254/323 |
| 2014/0238715 | A1 | 8/2014 | Eddowes et al. | |
| 2015/0167463 | A1 | 6/2015 | Jones et al. | |
| 2017/0328147 | A1* | 11/2017 | Roy | E21B 19/24 |
| 2018/0010454 | A1 | 1/2018 | Holdsworth et al. | |

* cited by examiner

CABLE FEEDER AND DRILL RIG

CROSS-REFERENCE TO RELATED APPLICATION

This application claims the benefit of prior-filed, U.S. Provisional Patent Application No. 62/794,915, filed Jan. 21, 2019, the entire contents of which are incorporated by reference.

FIELD

The present disclosure relates to a rock drilling tool and cable feeder, and particularly to a rig for forming a hole in a rock surface and for inserting a cable into a hole in a rock surface.

BACKGROUND

Drilling and bolting rigs may include an extendable frame and a drive unit movable along the frame for driving a drill bit into a rock surface. Components of a drilling and bolting rig are typically actuated by fluid power (e.g., hydraulic power). The drilling and bolting rig can perform drilling and bolting operations for various purposes, including reinforcement of mine walls and/or mine roof surfaces. In some cases, an expendable component such as a cable may be inserted or fed into a hole formed in a rock surface.

SUMMARY

In one independent aspect, a cable feed tool includes a first support, a second support coupled to the first support, a first roller supported on the first support for rotation and configured to drive a cable, and a second roller supported on the second support for rotation and configured to drive the cable. The first roller is also supported for pivoting movement relative to the second support about a pivot axis. The second roller is also supported for translational movement relative to the first support.

In another independent aspect, a drill rig includes a base frame, a feed frame, and a cable feeder. The base frame includes at least one rod, the rod being extendable in a direction parallel to a feed axis. The feed frame is supported for movement relative to the base frame in a direction parallel to the feed axis. The cable feeder is positioned adjacent a distal end of the at least one rod. The cable feeder includes a first roller and a second roller. The first roller is supported for rotation and configured to drive a cable, and the first roller also supported for pivoting movement about a pivot axis. The second roller is supported for rotation and configured to drive the cable, and the second roller is also supported for translational movement.

In yet another independent aspect, a drill rig includes a base frame, a feed frame, a rotation unit, and a cable feeder for driving a cable. The base frame includes at least one rod, the rod being extendable in a direction parallel to a feed axis and supporting a plurality of internal fluid passages conveying pressurized fluid. The feed frame is supported for movement relative to the base frame in a direction parallel to a feed axis. The rotation unit is configured to drive an expendable drill component. The drive unit is supported on the feed frame and moveable relative to the feed frame in a direction parallel to the feed axis. The cable feeder is positioned adjacent a distal end of the at least one rod and includes at least one actuator in fluid communication with the internal fluid passages of the rod.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
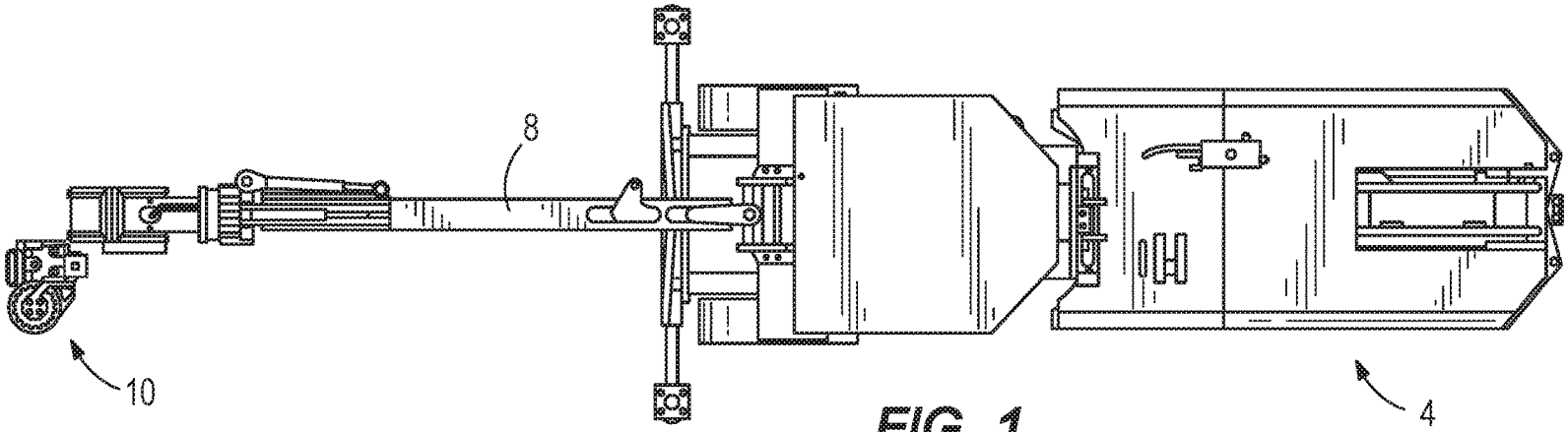
FIG. 1 is a plan view of a mobile machine.
Figure 2:
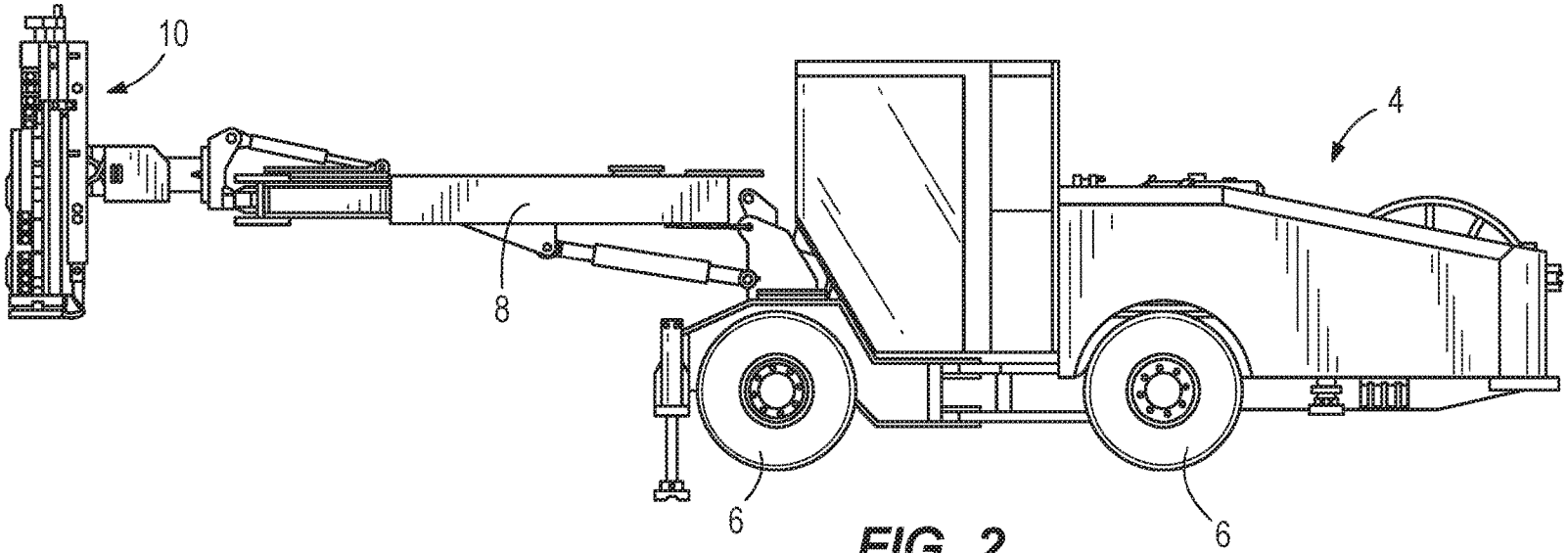
FIG. 2 is a side view of the mobile machine of FIG. 1.

FIGS. 1 and 2 illustrate a mobile mining machine 4, such as a low-height mobile roofbolting machine. In the illustrated embodiment, the machine 4 includes a frame or chassis supported by traction drive members 6 (e.g., wheels—FIG. 2), and a support member or boom 8 coupled to the chassis. The boom 8 supports a drilling and feeding tool, or drill rig 10, for forming holes in a mine surface (e.g., a roof, a floor, or a rib or side wall—not shown) and/or installing a support member (e.g., a cable—not shown). In the illustrated embodiment, the drill rig 10 performs both drilling and installation operations. In some embodiments, the boom 8 is extendable and includes a pivoting portion for supporting the drill rig 10. Among other things, an installed cable may anchor or support a safety mesh or screen to protect personnel against rock that may fall or become dislodged from the mine surface. In some embodiments, the drill rig 10 may be mounted on another type of mining machine, such as a continuous mining machine.

Figure 3:
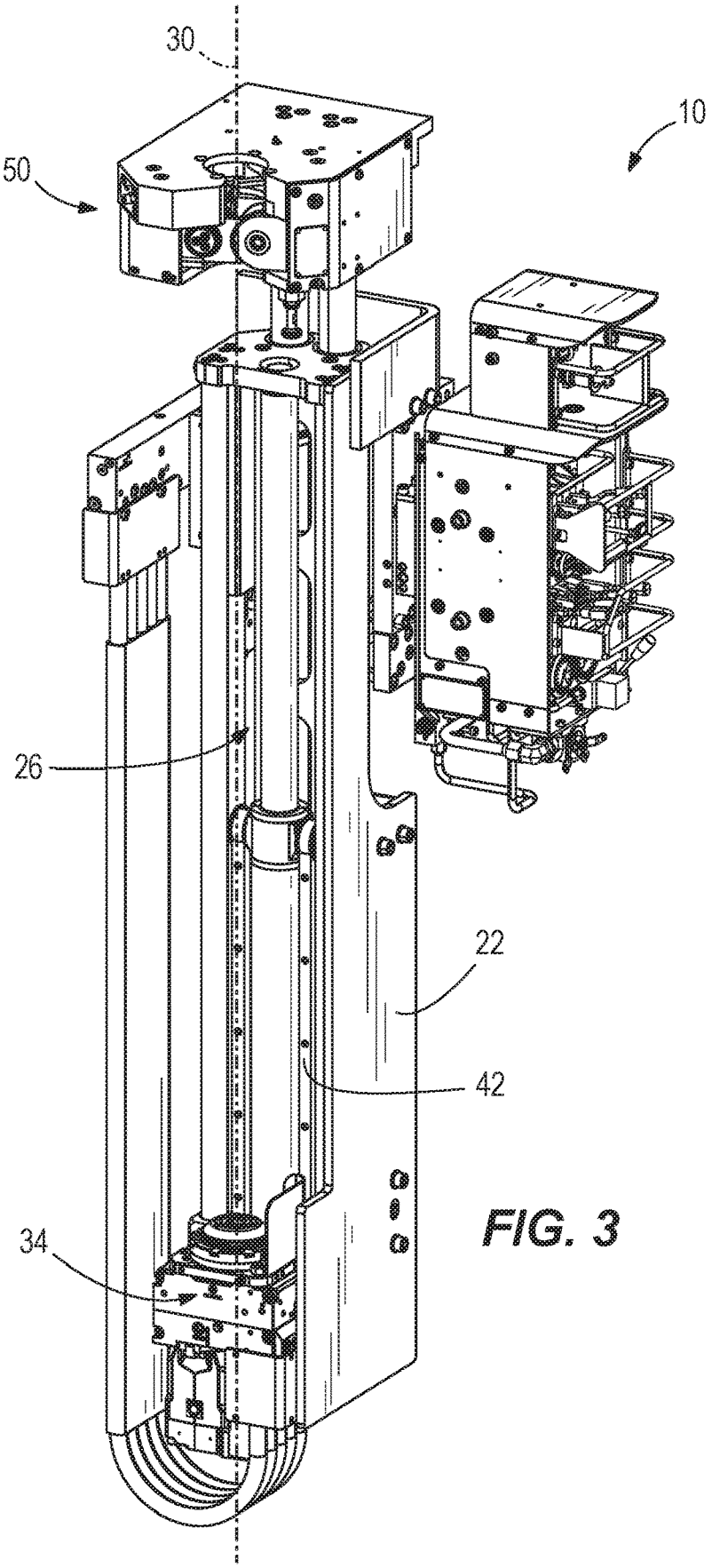
FIG. 3 is a perspective view of a drilling and feeding tool.
Figure 4:
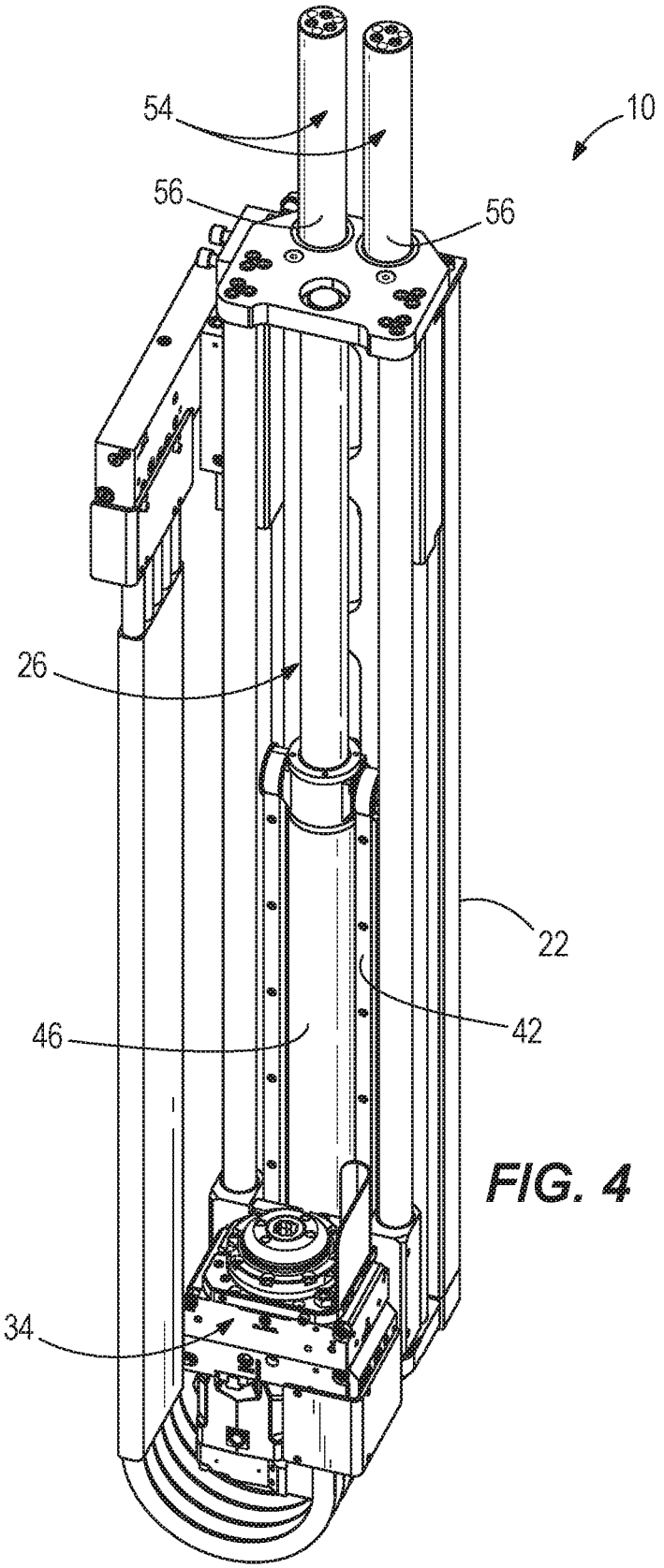
FIG. 4 is a perspective view of a portion of the drilling and feeding tool of FIG. 3, with a cable feeder removed.

As shown in FIGS. 3 and 4, the drill rig 10 includes a first stage or timber jack or base frame 22 and a second stage or feed frame 26 supported on the base frame 22. The feed frame 26 is movable relative to the base frame 22 in a direction parallel to a feed axis 30 (FIG. 3). Furthermore, a drive unit or rotation unit 34 is supported on the feed frame 26 and is movable relative to the feed frame 26 in a direction parallel to the feed axis 30. The rotation unit 34 rotates a bit or bolt (not shown) to drive the bit/bolt into a rock surface. In the illustrated embodiment, the rotation unit 34 is driven to move relative to the feed frame 26 by a chain and pulley drive 42, and via a hydraulic ram 46 (FIG. 4).

The drill rig 10 further includes a cable feeder 50 (FIG. 3) supported adjacent a distal or upper end of the base frame 22. The cable feeder 50 forms a top plate of the base frame 22, and is configured to be positioned adjacent a rock surface. Operation of the cable feeder 50 is described in further detail below. The base frame 22 includes a pair of timber jacks or base jacks 54 (FIG. 4), and the cable feeder 50 is supported on the base jacks 54. The base jacks 54 are extendable and retractable to move the cable feeder 50 relative to the base frame 22.

Figure 5:
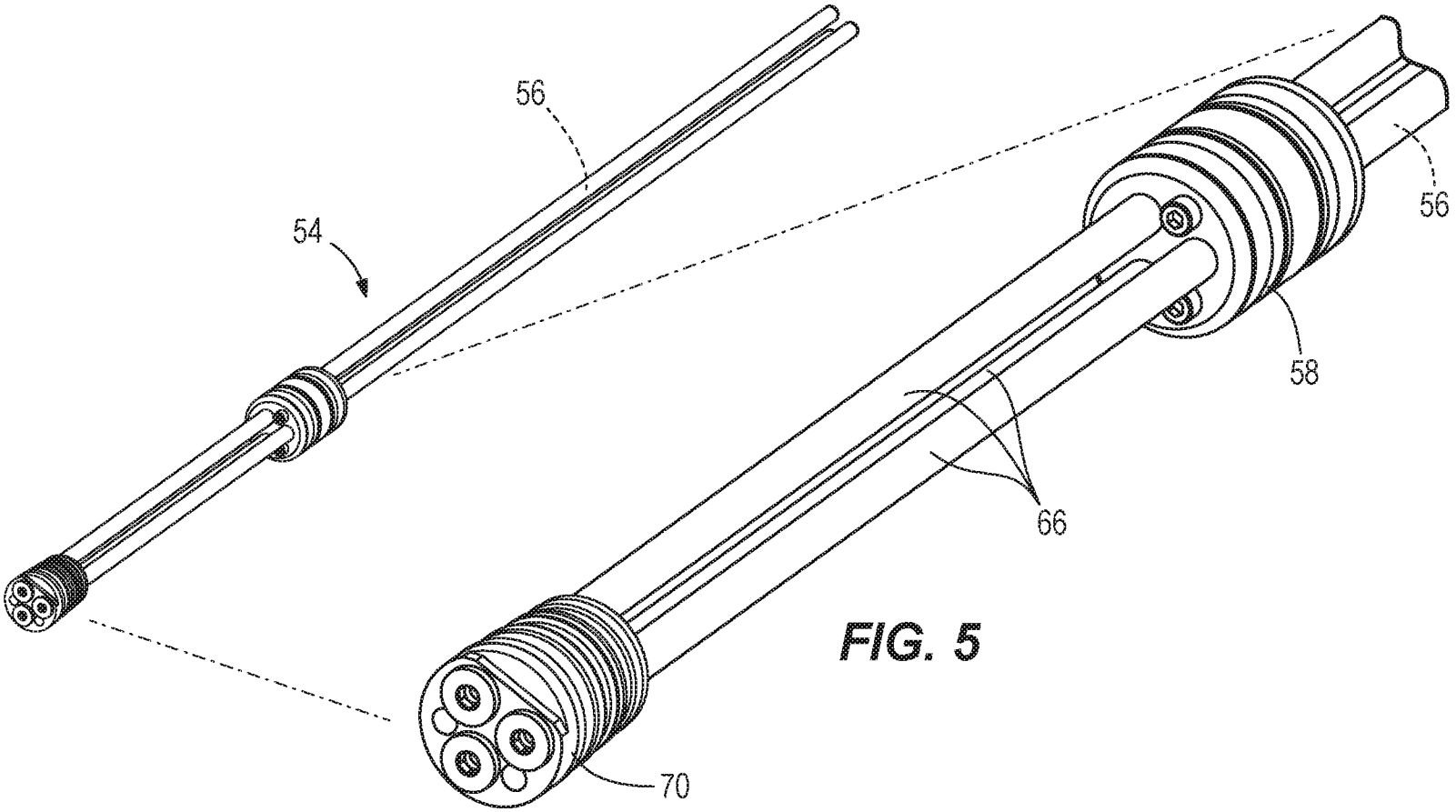
FIG. 5 is a perspective view of an internal portion of a base jack.

In the illustrated embodiment, the base jacks 54 are formed as telescoping cylindrical tubes 56. As best shown in FIG. 5, each base jack 54 includes a piston 58 positioned within an associated tube 56, and the piston 58 is movable relative to the tube 56 in response to a pressurized medium or fluid in the tube 56. In addition, a plurality of fluid conduits or trombones 66 extend through the tubes 56 to convey pressurized fluid to the cable feeder 50. In the illustrated embodiment, each tube 56 includes three trombones 66, and the trombones 66 are extendable with the tubes 56. The trombones 66 extend through the piston 58, which can include internal seals to seal the telescoping portions of the trombones 66. In addition, an end of each trombone 66 adjacent the cable feeder 50 is secured (e.g., by welding, threaded engagement, etc.) to a porting cartridge or block 70. In some embodiments, the block 70 is coupled to a manifold to direct pressurized fluid to the components of the cable feeder 50.

Positioning the fluid passages for the cable feeder 50 within the jacks 54 protects the fluid passages and reduces the need for external hoses, which can become overstressed or snagged in conventional drill rigs. The internal fluid passages also eliminate the need for hose management kits, and reduce the maintenance needs associated with hoses. In addition, the provision of multiple trombones 66 having relatively small diameters permits the base jacks 54 to maintain sufficient rigidity and resist stress and deformation in comparison to, for example, a single passage having a relatively large diameter.

Figure 6:
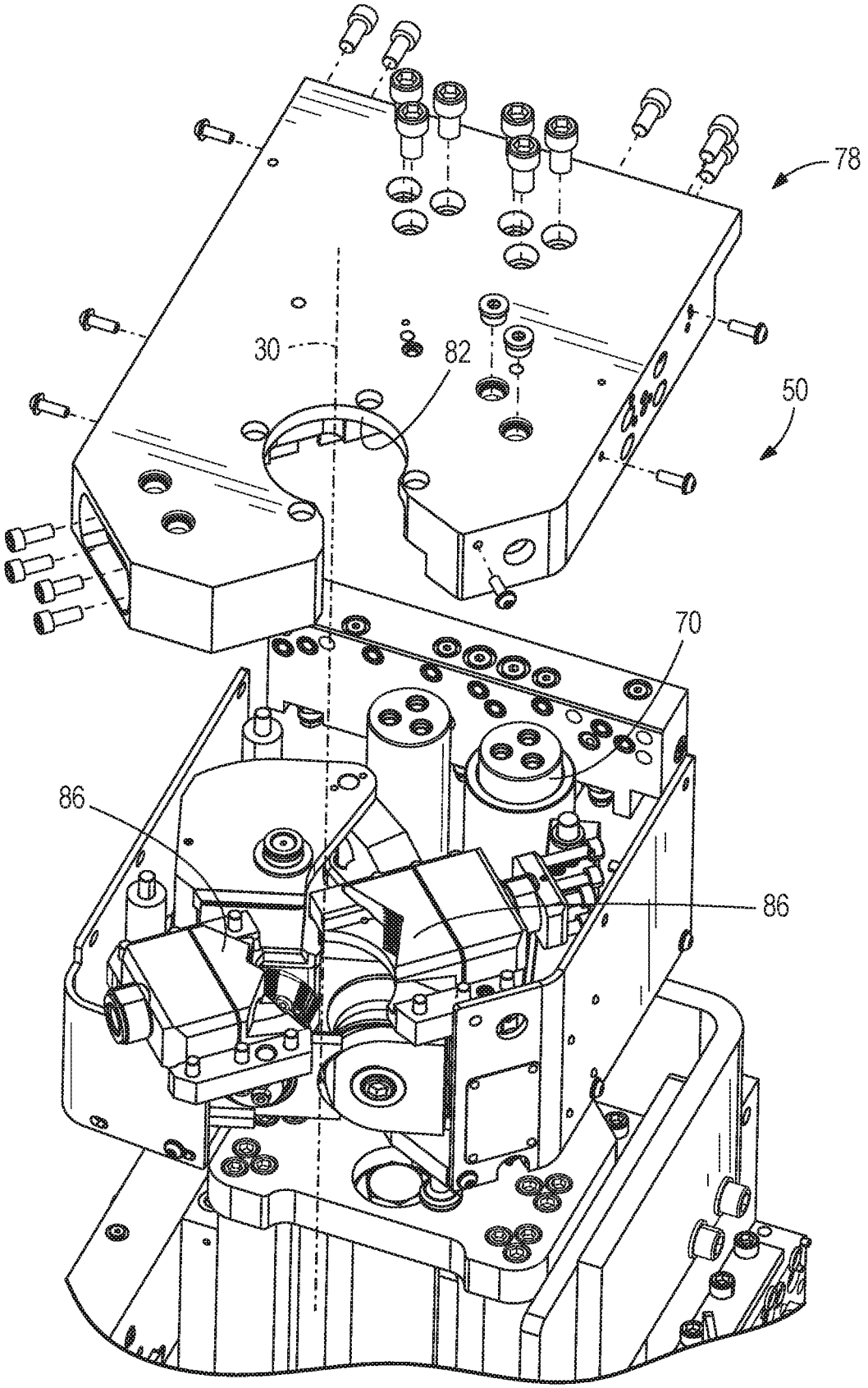
FIG. 6 is a partially exploded view of a cable feeder.

As shown in FIG. 6, the cable feeder 50 includes a housing 78 and a passageway or opening 82 aligned with the feed axis 30 through which a bit, bolt, or cable may pass. The cable feeder 50 includes a pair of clamp members 86 positioned on opposite sides of the opening 82, and each clamp member 86 is movable toward and away from the feed axis 30 to apply a compressive or clamping force on an expendable component (e.g., a cable) positioned in the opening 82. In the illustrated embodiment, the clamp members 86 are driven by a pressurized fluid (e.g., hydraulic fluid).

Figure 7:
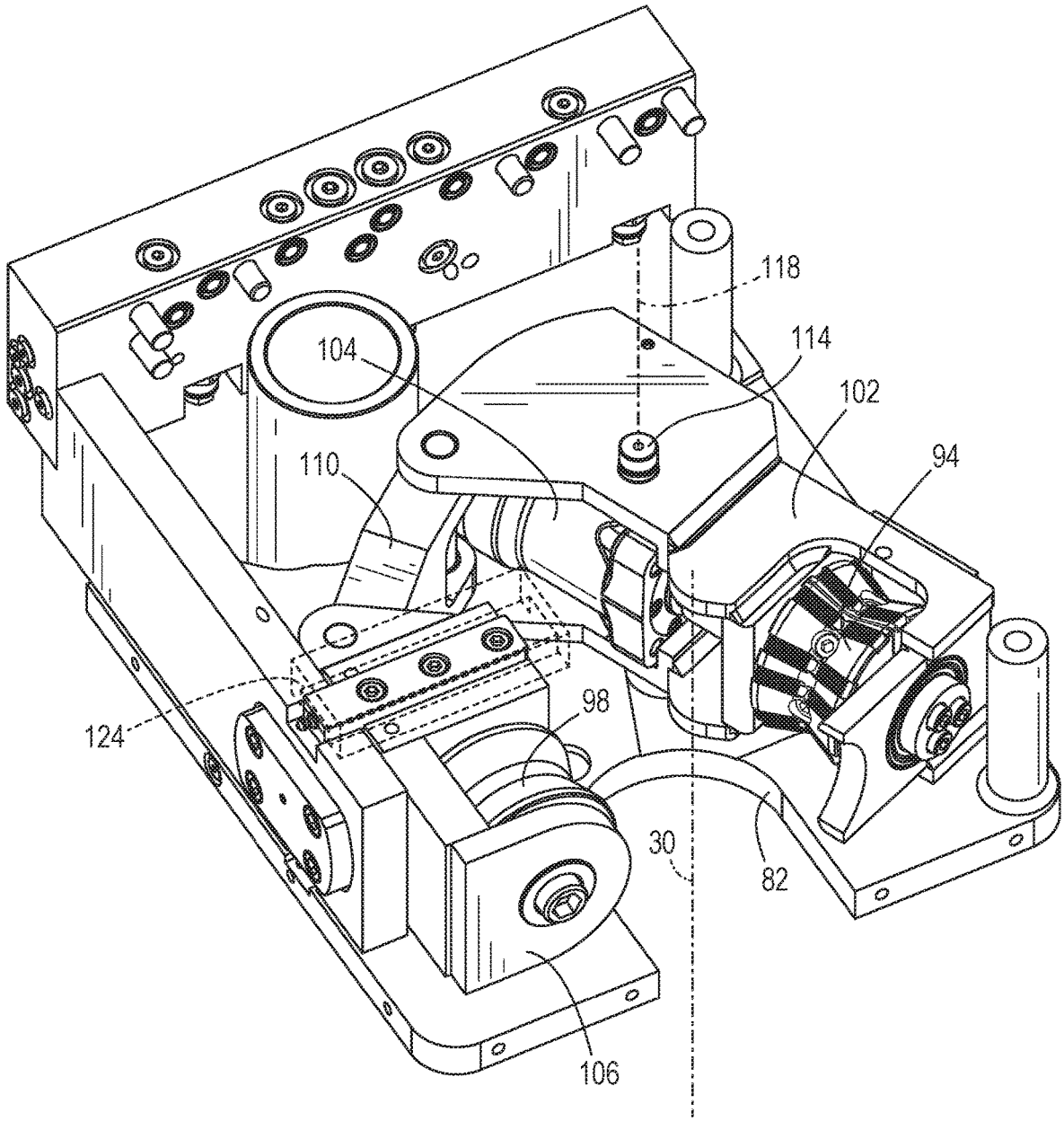
FIG. 7 is a perspective view of a drive system for the cable feeder of FIG. 6.

Referring now to FIG. 7, a drive system of the cable feeder 50 includes rollers 94, 98 for driving a cable through the opening 82. In the illustrated embodiment, the rollers 94, 98 are positioned between the feed frame 26 and the clamp members 86 (FIG. 6). A first roller or drive roller 94 is positioned on a first support 102 and is driven by a motor 104, while the second roller 98 is supported on a second support 106. In the illustrated embodiment, the second roller 98 is an idler roller and is not positively driven to rotate. The first support 102 and the second support 106 are coupled to one another by a link 110.

Figure 8:
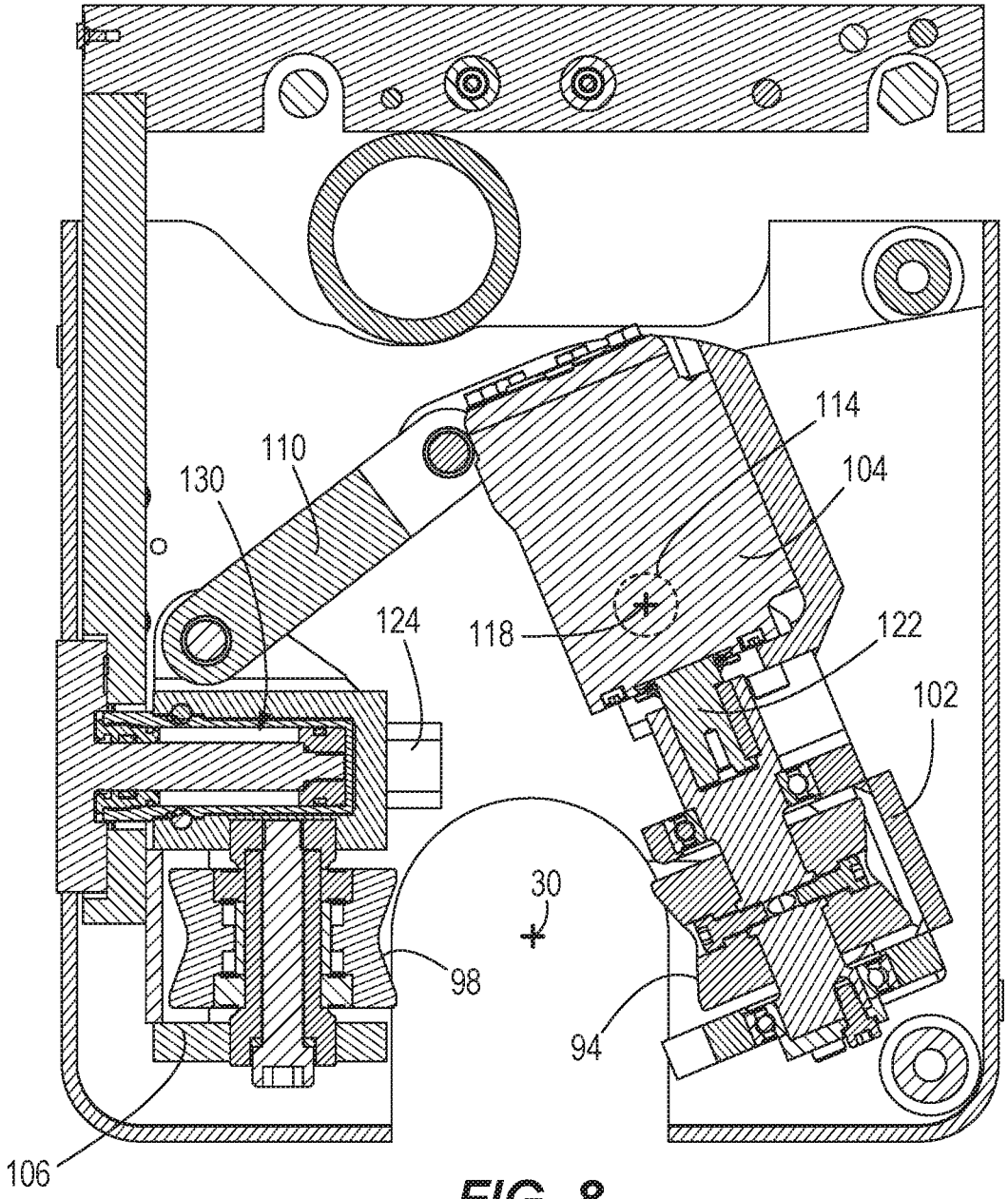
FIG. 8 is a plan view of the drive system of FIG. 7 with rollers in a first position.

In the illustrated embodiment, the first support 102 is supported by a post 114 for pivoting movement about a pivot axis 118 that is substantially parallel to the feed axis 30, and the motor 104 is also supported on the first support 102. The motor 104 can be hydraulically driven, and a motor output shaft 122 (FIGS. 8 and 9) is directly coupled to the drive roller 94. Also, in the illustrated embodiment, the second support 106 engages one or more rails or guides 124 and the second support 106 is movable in a translational manner along the guides 124. In the illustrated embodiment, the guides 124 are positioned adjacent upper and lower surfaces of the second support 106. A hydraulic ram 130 (FIGS. 8 and 9) is extendable and retractable to move the second support 106 along the guides 124, thereby moving the second roller 98 toward and away from the feed axis 30. The first roller 94 and the second roller 98 are therefore in opposing relationship relative to one another, with the roller 94, 98 engaging opposite sides of a cable. The hydraulic motor 104 and/or the hydraulic ram 130 are in fluid communication with one or more trombones 66 to receive pressurized fluid.

Figure 9:
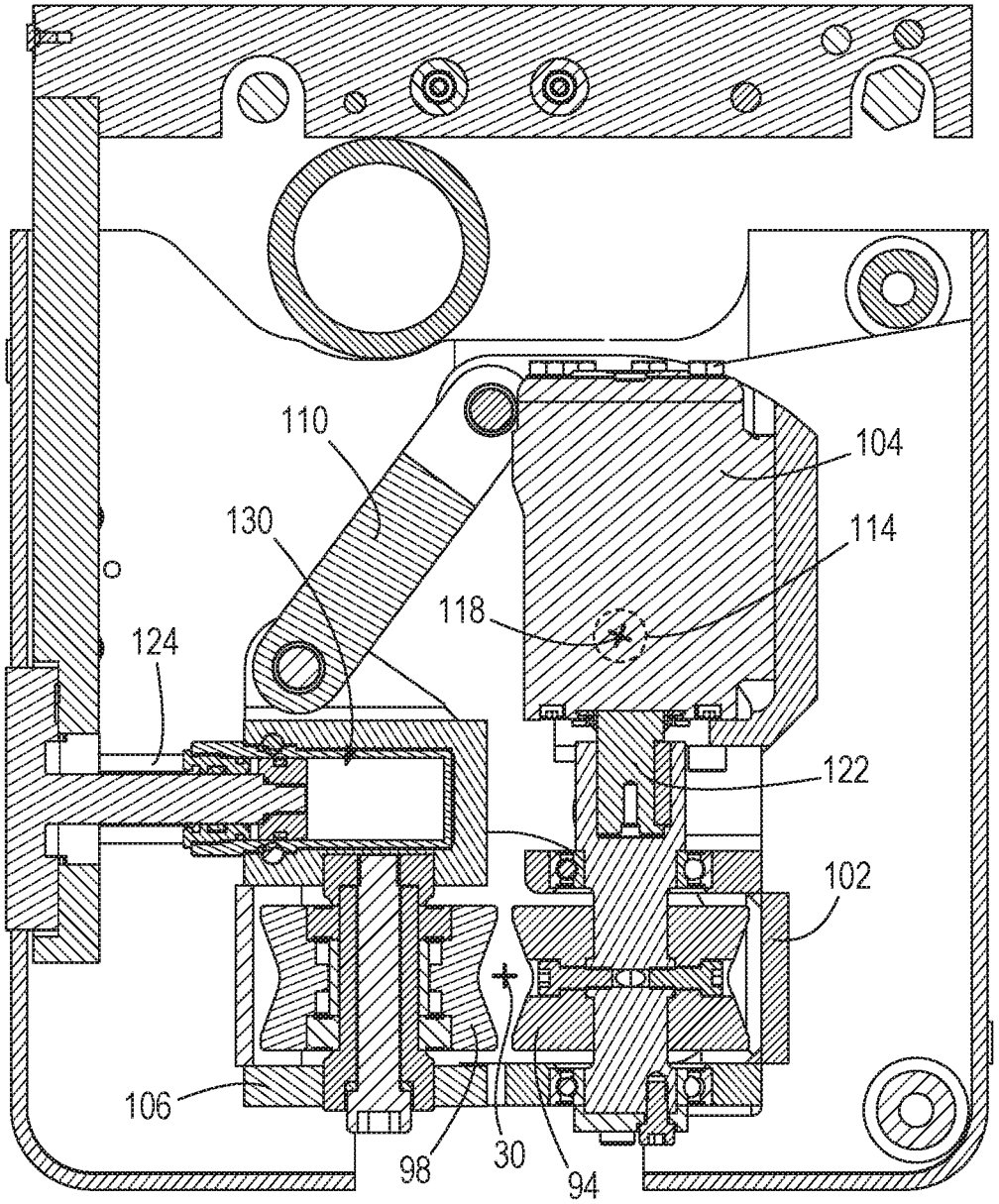
FIG. 9 is a plan view of the drive system of FIG. 7 with rollers in a second position.

As shown in FIG. 9, in the illustrated embodiment, extension of the hydraulic ram 130 causes the second support 106 and second roller 98 to move toward the feed axis 30. Due to the coupling between the first support 102 and second support 106 by the link 110, movement of the second support 106 causes pivoting movement of the first support 102 about the pivot axis 118 (e.g., clockwise in FIG. 9), thereby moving the drive roller 94 toward the feed axis 30. Accordingly, the drive roller 94 and the second roller 98 are brought toward one another to engage a cable (not shown) extending through the opening 82. A space between the drive roller 94 and the second roller 98 can be adjusted based on a thickness of the cable. The motor 104 drives the drive roller 94 to rotate, which in turn moves the cable through the opening 82. The cable feeder 50 provides a low-complexity design that includes a minimum number of moving parts. In addition, the components are formed in a common plane that is substantially perpendicular to the feed axis, creating a compact or low-height profile.

Although various aspects have been described in detail with reference to certain preferred embodiments, variations and modifications exist within the scope and spirit of one or more independent aspects as described. Various features and advantages are set forth in the following claims.

What is claimed is:

1. A cable feed tool comprising:

a first support;

a second support coupled to the first support;

a first roller supported on the first support for rotation and configured to drive a cable, the first roller also supported for pivoting movement relative to the second support about a pivot axis; and a second roller supported on the second support for rotation and configured to drive the cable, the second roller also supported for translational movement relative to the first support, a linear actuator for moving the second support, the linear actuator extendable in a direction parallel to a direction of translational movement of the second roller for at least a majority of a stroke of the linear actuator.

2. The cable feed tool of claim 1, wherein movement of one of the first roller and the second roller causes movement of the other of the first roller and the second roller.

3. The cable feed tool of claim 1, further comprising a motor driving one of the first roller and the second roller.

4. The cable feed tool of claim 1, wherein the first roller and the second roller are positioned in an opposing relationship and are configured to engage opposite sides of the cable.

5. The cable feed tool of claim 1, further comprising a guide engageable with the second support for facilitating translational movement.

6. The cable feed tool of claim 1, further comprising a link coupling the first support and the second support.

7. The cable feed tool of claim 1, wherein the first roller and the second roller are configured to drive the cable along a feed axis, wherein movement of the second roller toward the feed axis is associated with movement of the first roller toward the feed axis in opposed relationship.

8. The cable feed tool of claim 1, further comprising a gap positioned between the first roller and the second roller, wherein the gap is adjustable in size.

9. A drill rig comprising:

a base frame including at least one rod, the rod being extendable in a direction parallel to a feed axis;

a feed frame supported for movement relative to the base frame in a direction parallel to the feed axis; and a cable feeder positioned adjacent a distal end of the at least one rod, the cable feeder including, a first roller supported for rotation and configured to drive a cable, the first roller also supported for pivoting movement about a pivot axis, and a second roller supported for rotation and configured to drive the cable, the second roller also supported for translational movement relative to the first roller, a linear actuator for moving the second roller, the linear actuator extendable in a direction parallel to a direction of translational movement of the second roller for at least a majority of a stroke of the linear actuator.

10. The drill rig of claim 9, further comprising a drive unit configured to drive an expendable drill component, the drive unit supported on the feed frame and moveable relative to the feed frame in a direction parallel to the feed axis.

11. The drill rig of claim 9, wherein the cable feeder further includes a passageway through which the cable is configured to pass, and a plurality of clamp members movable relative to the opening.

12. The drill rig of claim 9, wherein the cable feeder further including a motor for driving one of the first roller and the second roller.

13. The drill rig of claim 9, wherein the cable feeder further includes a first support on which the first roller is supported, a second support on which the second roller is supported, and a link coupling the first support and the second support.

14. The drill rig of claim 9, wherein the cable feeder further includes a passageway through which the cable is configured to pass, wherein movement of the second roller toward the passageway is associated with movement of the first roller toward the passageway in opposed relationship.

15. A drill rig comprising:

a base frame including at least one rod, the rod being extendable in a direction parallel to a feed axis, the at least one rod supporting a plurality of internal fluid passages conveying pressurized fluid;

a feed frame supported for movement relative to the base frame in a direction parallel to a feed axis;

a rotation unit configured to drive an expendable drill component, the rotation unit drive unit supported on the feed frame and moveable relative to the feed frame in a direction parallel to the feed axis; and a cable feeder for driving a cable, the cable feeder positioned adjacent a distal end of the at least one rod, the cable feeder including at least one actuator in fluid communication with the internal fluid passages of the rod, wherein the plurality of internal fluid passages include trombones that are extendable within the rod in a direction parallel to the feed axis, the trombones extending through a piston that is positioned within the rod and movable relative to the rod.

16. The drill rig of claim 15, wherein the cable feeder further includes a first roller supported for rotation and configured to drive a cable, the first roller also supported for pivoting movement about a pivot axis, and a second roller supported for rotation and configured to drive the cable, the second roller also supported for translational movement.

17. The drill rig of claim 16, wherein the cable feeder further includes a passageway through which the cable is configured to pass, wherein movement of the second roller toward the passageway is associated with movement of the first roller toward the passageway in opposed relationship.

18. The drill rig of claim 16, wherein the at least one actuator includes a motor and an extendable hydraulic ram, wherein the motor drives one of the first roller and the second roller, wherein actuation of the hydraulic ram causes translational movement of the other of the first roller and the second roller.

* * * * *